US010253655B2

(12) United States Patent
Berning et al.

(10) Patent No.: US 10,253,655 B2
(45) Date of Patent: Apr. 9, 2019

(54) COUPLING A GAS TURBINE AND A STEAM TURBINE WITH A TARGET COUPLING ANGLE BY ADJUSTING THE POLAR WHEEL ANGLE

(71) Applicant: Siemens Aktiengesellschaft, Munich (DE)

(72) Inventors: Martin Berning, Mülheim an der Ruhr (DE); Marc Diefenbach, Mülheim an der Ruhr (DE); Marcel Langer, Oberhausen (DE); Martin Ophey, Straelen (DE); Dennis Schlüter, Hünxe (DE); Michael Winkel, Dorsten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/517,321

(22) PCT Filed: Oct. 5, 2015

(86) PCT No.: PCT/EP2015/072913
§ 371 (c)(1),
(2) Date: Apr. 6, 2017

(87) PCT Pub. No.: WO2016/062530
PCT Pub. Date: Apr. 28, 2016

(65) Prior Publication Data

US 2017/0306800 A1 Oct. 26, 2017

(30) Foreign Application Priority Data

Oct. 20, 2014 (EP) ..... 14189509

(51) Int. Cl.
*F01K 13/02* (2006.01)
*F01K 23/16* (2006.01)

(52) U.S. Cl.
CPC ..... *F01K 13/02* (2013.01); *F01K 23/16* (2013.01)

(58) Field of Classification Search
CPC .... F02C 3/10; F02C 3/107; F02C 6/00; F02C 7/26; F02C 7/32; F02C 7/36; F02C 9/00;
(Continued)

(56) References Cited

U.S. PATENT DOCUMENTS 5,483,147 A * 1/1996 Ilic ..... H02P 9/102 290/52
2001/0023576 A1 9/2001 Rollins
(Continued)

FOREIGN PATENT DOCUMENTS

EP 1911939 A1 4/2008
EP 2447482 A1 5/2012
(Continued)

OTHER PUBLICATIONS

EP Search Report dated Jun. 9, 2015, for EP patent application No. 14189509.4.
(Continued)

*Primary Examiner* — Mark Laurenzi
*Assistant Examiner* — Mickey France
(74) *Attorney, Agent, or Firm* — Beusse Wolter Sanks & Maire

(57) ABSTRACT

A method for coupling a gas turbine connected to a generator and a steam turbine, wherein the generator has an excitation winding, the excitation of which can be changed by changing an excitation current flowing through the excitation winding, the method having the following steps: a) accelerating and/or decelerating the steam turbine in such a way that the coupling takes place with a target coupling angle; b) if necessary, changing the excitation current such that the excitation of the excitation winding changed in this way
(Continued)

leads to a changed polar wheel angle, wherein the polar wheel angle is changed in such a way that the achieving of the target coupling angle is supported. In an analogous method, the polar wheel angle is changed for the purposes of improved decoupling. A corresponding control device is for coupling a gas turbine connected to a generator.

7 Claims, 1 Drawing Sheet

(58) Field of Classification Search
CPC ..... F02C 9/28; F02K 9/95; F05B 2220/702; F05B 2220/704; F05B 2220/706; F01K 13/02; F01K 3/22; F01K 23/16
USPC ... 60/772, 778, 39.13, 786, 788, 790, 39.15, 60/39.163, 793, 39.21, 39.2, 2, 646, 709, 60/716, 718
See application file for complete search history.

(56) References Cited

U.S. PATENT DOCUMENTS

| | | | | |
|---|---|---|---|---|
| 2004/0011040 | A1 | 1/2004 | Satoshi et al. | |
| 2004/0055272 | A1 | 3/2004 | Satoshi et al. | |
| 2005/0183422 | A1 | 8/2005 | Takai et al. | |
| 2009/0325765 | A1 | 12/2009 | Humer et al. | |
| 2010/0162721 | A1 | 7/2010 | Welch et al. | |
| 2017/0175711 | A1* | 6/2017 | Burkle | F03D 9/25 |

FOREIGN PATENT DOCUMENTS

| | | | |
|---|---|---|---|
| EP | 2818700 | A1 | 12/2014 |
| JP | 2013194609 | A | 9/2013 |
| RU | 2248453 | C2 | 3/2005 |
| RU | 2506440 | C2 | 2/2014 |
| WO | 2014125592 | A1 | 8/2014 |

OTHER PUBLICATIONS

International Search Report dated Oct. 29, 2015, for PCT/EP2015/072913.

Stolzle K. et al., "Synchronisierende Selbstschaltende Kupplungen für Ein-Wellen-Cogeneration-Kraftwerke"; Antriebstechnik, Vereinigte Fachverlage, Mainz, DE; Bd. 34; Nr. 8; pp. 46-49; XP000517052; ISSN: 0722-8546; 1995.

Hofmann W., "Blindleistung—Sichtbar gemacht"; Elektrotechnische Zeitschrift; ETZ; VDE Verlag GmbH, Berlin DE; Bd. 120; Nr. 10; pp. 18; 20/21; XP000927072; ISSN: 0948-7387; 1999.

IPPR (PCT/IPEA/416) dated Nov. 21, 2016, for PCT/EP2015/072913.

RU search report dated Apr. 26, 2018, for RU patent application No. 2017113069/06.

CN search report dated Aug. 3, 2018, for corresponding CN patent application No. 2015800571316.

* cited by examiner

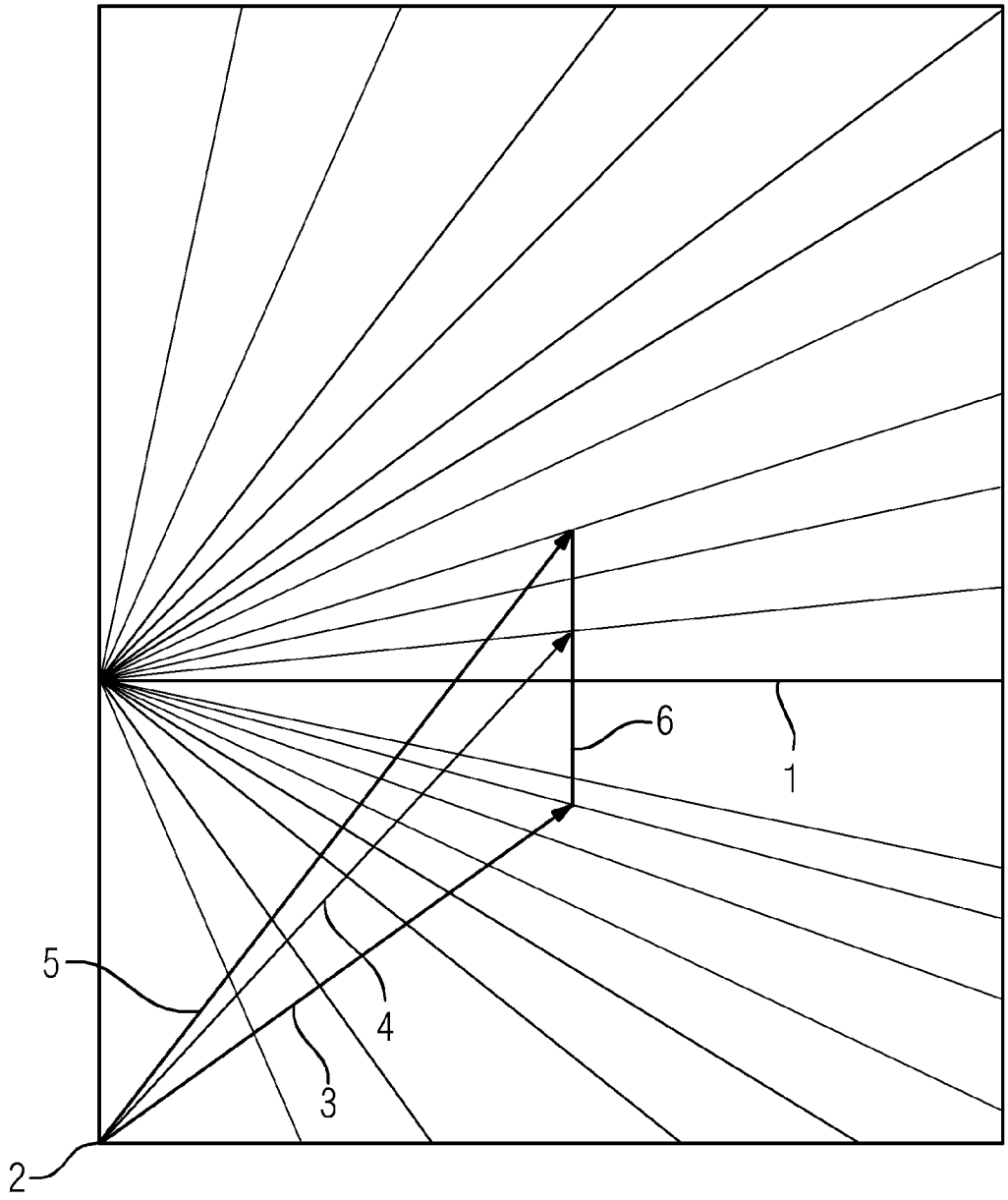
6
1
5
4
3
2

COUPLING A GAS TURBINE AND A STEAM TURBINE WITH A TARGET COUPLING ANGLE BY ADJUSTING THE POLAR WHEEL ANGLE

CROSS REFERENCE TO RELATED APPLICATIONS

This application is the US National Stage of International Application No. PCT/EP2015/072913 filed Oct. 5, 2015, and claims the benefit thereof. The International Application claims the benefit of European Application No. EP14189509 filed Oct. 20, 2014. All of the applications are incorporated by reference herein in their entirety.

FIELD OF INVENTION

The invention relates to coupling a gas turbine and a steam turbine with a target coupling angle by adjusting the polar wheel angle.

BACKGROUND OF INVENTION

When starting gas turbine power plants, it is often required also to start the steam turbine as soon as sufficient steam for driving the steam turbine can be provided by the waste heat of the gas turbine. For this purpose, the gas turbine and the steam turbine are coupled by means of a coupling. Particularly to avoid imbalances, ways of using a specific control of the coupling operation to couple with a target coupling angle are adopted. For this purpose, the steam turbine is accelerated in a suitable way. The frequency of the gas turbine is prescribed to the extent that it must coincide with the frequency of the power grid into which the feeding is taking place.

EP 1 911 939 A1 discloses a method for coupling an input shaft of a turbo machine to an output shaft by means of a coupling. The turbo machine is brought up to a speed that is subsynchronous to the speed of the output shaft and is kept at this holding speed before a signal for starting the coupling is set to achieve coupling with the target coupling angle. The turbo machine is generally a steam turbine and the output shaft is the shaft for driving the generator.

SUMMARY OF INVENTION

An object of the invention is to provide a possibility for improved coupling with a target coupling angle. The way in which this object is achieved can be found in particular in the independent claims. The dependent claims specify advantageous further developments. Further information is contained in the description and in the drawings.

A method for coupling a gas turbine connected to a generator and a steam turbine is provided, the generator having an excitation winding. The excitation of the excitation winding can be changed by changing an excitation current flowing through the excitation winding. The method comprises the following steps: a) accelerating and/or decelerating the steam turbine in such a way that the coupling takes place with a target coupling angle; b) if necessary, changing the excitation current, so that the thus-changed excitation of the excitation winding leads to a changed polar wheel angle, the polar wheel angle being changed in such a way as to be conducive to achieving the target coupling angle.

It is clear that step a) and step b) overlap at least partially in time. Step b) will always take place whenever it is not possible to achieve the target coupling angle by step a), or only with difficulty, for instance it is not possible in a short time. Step a) is known, and so nothing further is to be said in this respect.

Step b) is to be explained in more detail. There is a degree of freedom of the excitation current that causes the excitation of the excitation winding. As a result, the so-called polar wheel angle can be influenced. The polar wheel angle, also known as the load angle, is generally to be understood as meaning the angle at which the polar wheel of a synchronous machine is leading the synchronous rotating field. The details are not to be discussed here because they are known to a person skilled in the relevant art. It is important to understand that a change of the polar wheel angle has the effect of changing the reactive power, but it is still possible to provide the required effective power. Changing the polar wheel angle makes it possible to satisfy the requirement that the generator rotates at grid frequency and at the same time a change of the angular position of the generator, and consequently of the gas turbine, is achievable. The invention therefore allows not only the angular position of the steam turbine but also the angular position of the gas turbine to be influenced. Even though it is generally only possible to exert an influence amounting to a few degrees, this nevertheless provides an additional degree of freedom, which can if necessary greatly facilitate and accelerate the coupling with the target coupling angle.

The polar wheel angle is dependent on the ratio of the effective power and the reactive power. Since the ratio of the effective power and the reactive power depends on the excitation, that is to say the excitation current, making the appropriate choice of the reactive power for a given effective power is in principle synonymous to saying that the excitation current should be chosen appropriately. It is clear from the interrelationships that it is not necessary to detect the polar wheel angle directly. It is basically sufficient to change the reactive power appropriately for a given effective power. It is consequently possible in the control to resort to the variables that are detected in any case, the effective power and the reactive power. The interrelationships between the effective power, the reactive power and the polar wheel angle can be taken from a so-called power diagram, as explained in more detail later.

In one embodiment, when the gas turbine is leading with respect to the target coupling angle, the excitation current is raised and, when the gas turbine is lagging, the excitation current is lowered. Generally, the polar wheel angle can be lowered by increasing the excitation. Therefore, the angle by which the polar wheel is leading the synchronous rotating field is lowered. The generator, and consequently the gas turbine, are therefore as it were turned back somewhat, so that the leading of the gas turbine with respect to the target coupling angle is eliminated.

In one embodiment, the changing of the excitation current is used to compensate for fluctuations of the grid frequency that make it more difficult for the target coupling angle to be achieved. Even though it is desired in principle to keep the grid frequency as constant as possible, in Germany for example a value of 50 Hz is aimed for, minor fluctuations nevertheless occur. If these occur during the coupling, that is to say especially also prior to the actual coupling, while the steam turbine is being accelerated or decelerated, it is often no longer possible to adapt the acceleration of the steam turbine correspondingly. In this case, the changing of the excitation current and the accompanying changing of the polar wheel angle, and consequently the changing of the angular position of the gas turbine, are very important, if not indispensable, for quickly coupling with the target coupling angle.

In one embodiment, the changing of the excitation current allows the angle of the gas turbine to be variable by up to 5°. As already explained, though the achievable angular change is relatively limited, it is nevertheless important. It is still true that the main degree of freedom in the coupling is given by the suitable acceleration of the steam turbine and the choice of the coupling time.

In one embodiment, the excitation voltage is changed to change the excitation current. This allows influencing of the excitation current in an easy way.

The above considerations may also be used for a method for uncoupling a steam turbine and a gas turbine connected to a generator. The generator has once again an excitation winding, the excitation of which can be changed by changing an excitation current flowing through the excitation winding. When uncoupling, the excitation current is changed in such a way that the thus-changed excitation of the excitation winding leads to a changed polar wheel angle, which facilitates uncoupling. As already described above for coupling, the changing of the polar wheel angle allows the turning of the gas turbine. In certain situations, this may be advantageous when uncoupling, that is to say when releasing the coupling between the gas turbine and the steam turbine. In particular, it is often possible to accelerate the uncoupling. This reduces the wear of the coupling.

A control device for a single-shaft turbo set with a gas turbine, a steam turbine and a generator is likewise provided. The control device is designed in such a way that the method described above for coupling and/or uncoupling can be carried out. Marginal changes to the control device that is present in any case are often sufficient for this. In many cases, it is possible to restrict the changes to different programming. The implementation of the method according to the invention consequently only requires very limited expenditure. Normally, retrofitting of existing single-shaft turbo sets, strictly speaking the associated control device, is also possible without any problem.

BRIEF DESCRIPTION OF THE DRAWINGS

Further details are to be described on the basis of FIG. 1, which shows a power diagram in which the interrelationships between the reactive power, the effective power and the polar wheel angle are represented.

DETAILED DESCRIPTION OF INVENTION

The effective power in MW is plotted on the abscissa of FIG. 1. The reactive power in Mvar is plotted on the ordinate. For the reactive power, the line 1 passes through 0. For the operating points lying on the line 1, therefore, only effective power is provided. For the operating points lying under the line 1, the reactive power is negative, for those lying above it is positive. The straight lines ending at the edge stand for certain values of cos phi, phi being the angle between the voltage induced in the generator and the resultant current in the phasor diagram.

The arrows 3, 4 and 5 extending from an origin 2 lying at the bottom left are significant in the present case. As can be seen, these end at operating points with the same effective power, but different reactive power. The line 6 that joins the two end points of the arrows 3 and 5 is a typical range in which the reactive power can be adjusted while the effective power remains the same.

The angle between the arrows 3, 4 and 5 and the ordinate is the respective polar wheel angle. The position of the origin 2 is determined by the measurement technology. Generally, the polar wheel angle can be read off in the power diagram by taking an arrow from the origin 2 to the respective operating point and determining the angle of this arrow in relation to the ordinate.

If for instance coupling is performed at the operating point that lies at the end of arrow 4 and it is established by the control that, for coupling with the target coupling angle, the gas turbine is leading by 2°, it is then appropriate to lower the polar wheel angle by 2°. As can be seen in the power diagram that is shown in FIG. 1, for this purpose the reactive power has to be increased. This requires that the excitation, that is to say the excitation voltage and consequently the excitation current, have to be lowered until the polar wheel angle is 42°. It is therefore possible in an easy way, by changing the reactive power that can be brought about by changed excitation, to influence the polar wheel angle, and consequently to influence the target coupling angle in an improved way.

The invention claimed is:

1. A method for coupling a gas turbine connected to a generator and a steam turbine, the generator having an excitation winding, the excitation of which is changed by changing an excitation current flowing through the excitation winding, the method comprising:

a) accelerating and/or decelerating the steam turbine in such a way that the coupling to the gas turbine takes place with a target coupling angle;

b) when necessary, changing the excitation current, so that the thus-changed excitation of the excitation winding leads to a changed polar wheel angle, wherein the polar wheel angle being changed in such a way as to be conducive to achieving the target coupling angle.

2. The method as claimed in claim 1, wherein when the gas turbine is leading with respect to the target coupling angle, the excitation current is raised and, when the gas turbine is lagging, the excitation current is lowered.

3. The method as claimed in claim 1, wherein the changing of the excitation current is used to compensate for fluctuations of the grid frequency that make it more difficult for the target coupling angle to be achieved.

4. The method as claimed in claim 1, wherein the changing of the excitation current allows the angle of the gas turbine to be variable by up to 5°.

5. The method as claimed in claim 1, wherein the excitation voltage is changed to change the excitation current.

6. A method for uncoupling a steam turbine and a gas turbine connected to a generator, the generator having an excitation winding, the excitation of which can be changed by changing an excitation current flowing through the excitation winding, the method comprising:

changing the excitation current in such a way that the thus-changed excitation of the excitation winding leads to a changed polar wheel angle, which facilitates uncoupling the gas turbine and the steam turbine.

7. A control device for a single-shaft turbo set with a gas turbine, a steam turbine and a generator, wherein the control device is adapted to carry out a method as claimed in claim 1.

* * * * *